US005797305A

United States Patent [19]

Harrod et al.

[11] Patent Number: 5,797,305

[45] Date of Patent: Aug. 25, 1998

[54] ON DEMAND CROSS WEB PERFORATION

[75] Inventors: Jimmie A. Harrod, Grand Island; Dennis R. Bernard, Amherst, both of N.Y.

[73] Assignee: Moore Business Forms, Inc., Grand Island, N.Y.

[21] Appl. No.: 600,065

[22] Filed: Feb. 12, 1996

[51] Int. Cl.[6] ..... B26D 1/62; B26D 5/20; B26F 1/20

[52] U.S. Cl. ..... 83/37; 83/76.7; 83/304; 83/346; 83/678

[58] Field of Search ..... 83/37, 76.1, 76.6, 83/76.7, 76.9, 304, 305, 346, 678, 74

[56] References Cited

U.S. PATENT DOCUMENTS

| | | | |
|---|---|---|---|
| 162,607 | 4/1875 | Beidinger | 83/345 X |
| 947,100 | 1/1910 | Fuller | 83/346 |
| 2,059,187 | 10/1936 | Talbot . | |
| 2,341,956 | 2/1944 | Staube | 83/346 X |
| 3,138,074 | 6/1964 | Hartbauer . | |
| 3,866,497 | 2/1975 | Wolfberg et al. | 83/37 X |
| 4,594,926 | 6/1986 | Propheter | 83/345 |
| 4,656,905 | 4/1987 | Ginzburg et al. | 83/305 X |
| 4,685,318 | 8/1987 | Ueda et al. | 83/304 X |
| 4,691,606 | 9/1987 | Johnson et al. | 83/346 X |
| 4,705,225 | 11/1987 | Miyazaki et al. . | |
| 4,781,090 | 11/1988 | Feldkamper et al. | 83/74 |
| 4,799,414 | 1/1989 | Scheffer et al. | 83/103 |
| 5,001,950 | 3/1991 | Fokos et al. | 83/37 |
| 5,024,128 | 6/1991 | Campbell, Jr. | 83/37 X |
| 5,098,366 | 3/1992 | Gressman | 83/305 X |
| 5,122,964 | 6/1992 | Hayashi et al. | 83/37 X |
| 5,146,820 | 9/1992 | Nemeth et al. | 83/37 |
| 5,152,205 | 10/1992 | Yoshida et al. | 83/304 |
| 5,297,461 | 3/1994 | Hirakawa et al. | 83/304 |

*Primary Examiner*—Eugenia Jones
*Attorney, Agent, or Firm*—Nixon & Vanderhye P.C.

[57] ABSTRACT

A moving web is either perforated or cut using a knife cylinder having at least one blade, and an anvil cylinder having at least one raised anvil surface, and preferably a plurality (e.g. about 22) of alternating substantially uniform raised surfaces and depressions. The knife cylinder is substantially continuously rotated, and the anvil cylinder is substantially continuously rotated by a servo motor, which also positively controls the position of the anvil cylinder with respect to the knife cylinder to selectively either effect perforation or cutting of the web, or no perforation or cutting. Position controlling is typically accomplished by substantially constantly and instantly indexing the anvil cylinder in a reverse direction. Sensors may be utilized for sensing the locations of the knife and anvil cylinders and providing that information to a computer controller to facilitate indexing.

17 Claims, 5 Drawing Sheets

ON DEMAND CROSS WEB PERFORATION

BACKGROUND AND SUMMARY OF THE INVENTION

There are many situations in which it is desirable to produce, on demand, cross perforations, or severing operations, in association with webs. For example, in the manufacture of business forms, it is often very desirable to perforate or cut single or multiple ply paper webs. It is particularly desirable to be able to effect perforation or cutting while a knife cylinder and associated anvil cylinder are continuously operating, i.e. without stopping the cylinders.

According to the present invention not only is it possible to on demand either effect cross perforation or severing without stopping operation of equipment components, it is also possible to operate the anvil cylinder so that the knife cylinder blade coacts with a different anvil surface each cycle. This not only extends the life of the anvil cylinder, but reduces total system inertia. Thus, by practicing the present invention it is possible to operate at high speed with accurate placement of the cross perforations or cuts in the web.

According to one aspect of the present invention a method of acting on a moving web to effect perforation or cutting thereof is provided. The method uses a knife cylinder having at least one knife blade and an anvil cylinder having at least one raised anvil surface for cooperating with the knife blade to effect cutting or perforation, and at least one depression adjacent the raised surface which does not effect perforation or cutting when cooperating with the knife blade. The method comprises the following steps: (a) Substantially continuously rotating the knife cylinder in substantial registration with the moving web. (b) Substantially continuously rotating the anvil cylinder. And (c) while practicing steps (a) and (b), positively controlling the position of the anvil cylinder with respect to the knife cylinder so that selectively a raised anvil surface or depression is brought into operative association with the knife blade to selectively effect perforation or cutting of the web, or no perforation or cutting, respectively.

Steps (b) and (c) may be practiced by rotating the anvil cylinder with a servo motor, and phase shifting the anvil cylinder to change between perforating or cutting, or non-perforating or non-cutting positions. Preferably the anvil cylinder comprises a plurality of substantially uniform alternating raised surfaces and depressions, and step (b) is practiced by rotating the anvil cylinder in a first direction, and step (c) is practiced by substantially constantly and instantly indexing the anvil cylinder in a direction opposite the first direction. Typically a computer controller is provided operatively connected to the knife and anvil cylinders, and there are the further steps of sensing the locations of the knife and anvil cylinders and providing the sensed location information to the computer controller to facilitate the practice of step (c). Step (c) is typically practiced by phase shifting the anvil cylinder between about 5–10 degrees during each indexing action. By merely replacing the knife blade or blades in the knife cylinder, steps (a) through (c) may be practiced to effect either cutting or cross perforating.

According to another aspect of the present invention apparatus for cutting or perforating a web is provided comprising the following components: A knife cylinder having at least one cutting or perforating knife blade extending outwardly therefrom. An anvil cylinder having at least one raised anvil surface for cooperating with a the knife blade to effect cutting or perforation, and at least one depression adjacent the raised surface which does not effect perforation or cutting when cooperating with a the knife blade. A drive mechanism for driving the knife cylinder. And a servo motor operatively connected to the anvil cylinder to effect rotation thereof and for positively controlling the location of the anvil cylinder with respect to the knife cylinder to selectively provide perforation or cutting, or no perforation or cutting.

Typically the apparatus also includes an encoder operatively connected to the knife cylinder to insure synchronized (with the web) operation of the knife cylinder. The anvil cylinder typically comprises a plurality of substantially uniform alternating raised surfaces and depressions; for example, between about 20–25 each of alternating raised surfaces and depressions are provided (e.g. 22 of each). By "substantially uniform" is meant that all of the raised surfaces have approximately the same arcuate extent and height, and each of the depressions has substantially the same arcuate extent as each of the raised surfaces. A computer controller is typically provided for controlling operation of the servo motor and a position sensor is associated with each of the knife cylinder and the anvil cylinder for providing position information to the computer controller. Typically two knife blades are provided spaced approximately 180 degrees from each other, and readily replaceable to either put in new or sharper blades, or to change between cutting and cross perforating blades.

According to another aspect of the present invention cutting or cross perforating web apparatus is provided comprising the following components: A knife cylinder having at least one cutting or perforating knife blade extending outwardly therefrom. An anvil cylinder having a plurality of substantially uniform anvil surfaces for cooperating with the knife blade to effect cutting or perforation, and a plurality of substantially uniform depressions alternating with the raised surfaces which do not effect perforation or cutting when cooperating with the knife blade. A drive mechanism for driving the knife cylinder. And a drive mechanism for rotating the anvil cylinder in a first direction; and for substantially constantly and instantly indexing the anvil cylinder in a direction opposite the first direction to provide either perforating or cutting, or no perforating or cutting. Details of the components are preferably as described above.

It is a primary object of the present invention to provide for the accurate, fast, and long life cross perforating or cutting of moving webs, such as during the production of paper business forms. This and other objects of the invention will become clear from an inspection of the detailed description of the invention and from the appended claims.

DETAILED DESCRIPTION OF THE DRAWINGS

Figure 1:
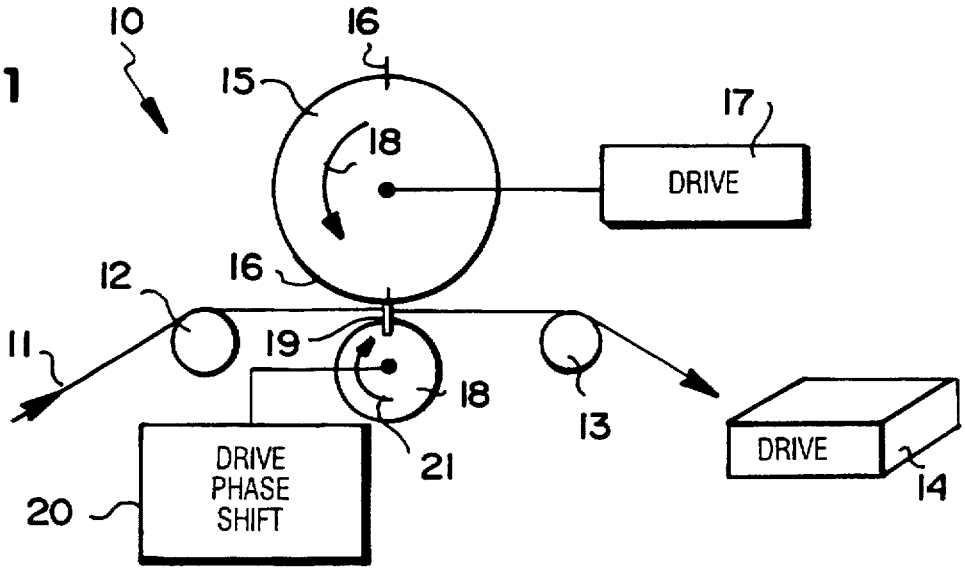
FIG. 1 is a side schematic view illustrating schematically apparatus for practicing a method of effecting cross perforation or severing of a web.
Figure 2:
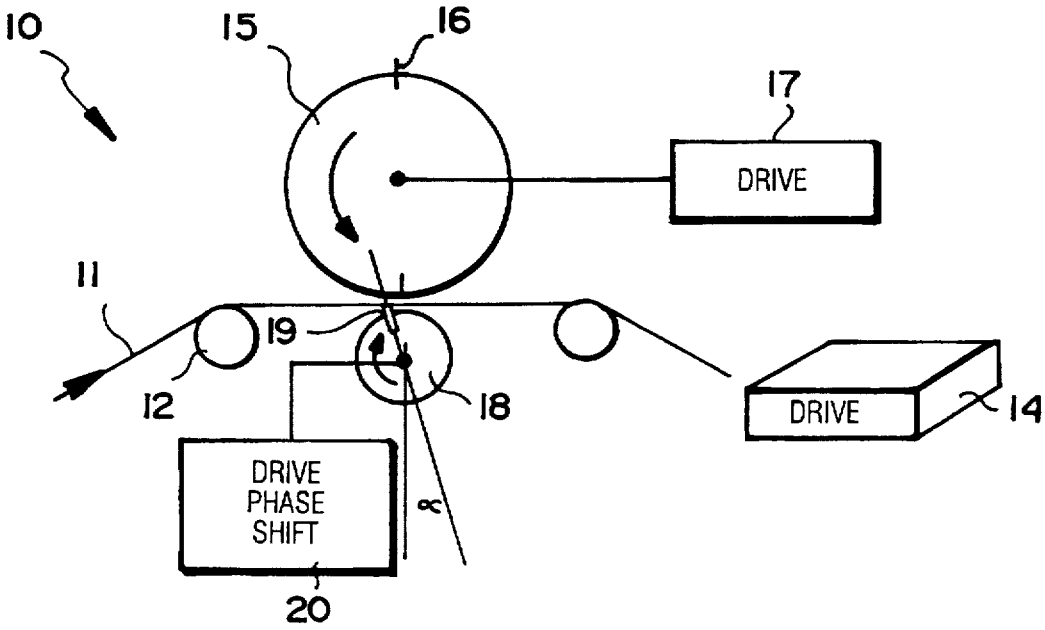
FIG. 2 is a view like that of FIG. 1 showing the same apparatus for selectively non-perforating or cutting.

FIGS. 1 and 2 schematically illustrate on demand web cross perforating or severing according to the present invention. FIG. 1 schematically illustrates relative positioning between components and operation so that cross perforating or cutting is practiced, while FIG. 2 illustrates the same apparatus operated so that there is no perforating or cutting. One can switch on demand between the two modes of FIGS. 1 and 2.

A general apparatus for cross perforating or cutting is shown schematically in FIGS. 1 and 2 as indicated generally by reference numeral 10, and operates on a web 11 such as a single ply or multiple ply paper web for the production of business forms, although webs of other materials may be also utilized. The web 11 typically passes over rollers 12, 13 or the like, and is driven by a conventional drive mechanism, illustrated schematically at 14 in FIGS. 1 and 2, but positional along any or multiple portions of the web 11 to effectively continuously move web 11.

A knife cylinder 15 is provided which has one or more knife blades 16 extending radially outwardly from the outer periphery thereof, and is driven substantially continuously by the drive 17 in the direction 18 about an axis (typically an approximately horizontal axis). The knife cylinder 15 cooperates with an anvil cylinder 18 which has one or more raised surfaces 19 (which may comprise a hardened insert) extending outwardly from the outer periphery thereof, with one or more depressions (e.g. merely the outer periphery of the cylinder 18 in the embodiment illustrated in FIGS. 1 and 2) driven substantially continuously by the drive 20 in the direction 21. The drive 20 comprises a drive mechanism that is capable of phase shifting the anvil cylinder 18 so that one or more raised anvil surfaces 19 thereof are either in synch with the perforations or cutting blade 16 to effect cutting or perforation (as in FIG. 1), or out of synch (e.g. about 3–10 degrees) so that there is no perforating or cutting, as schematically illustrated in FIG. 2.

Figure 3:
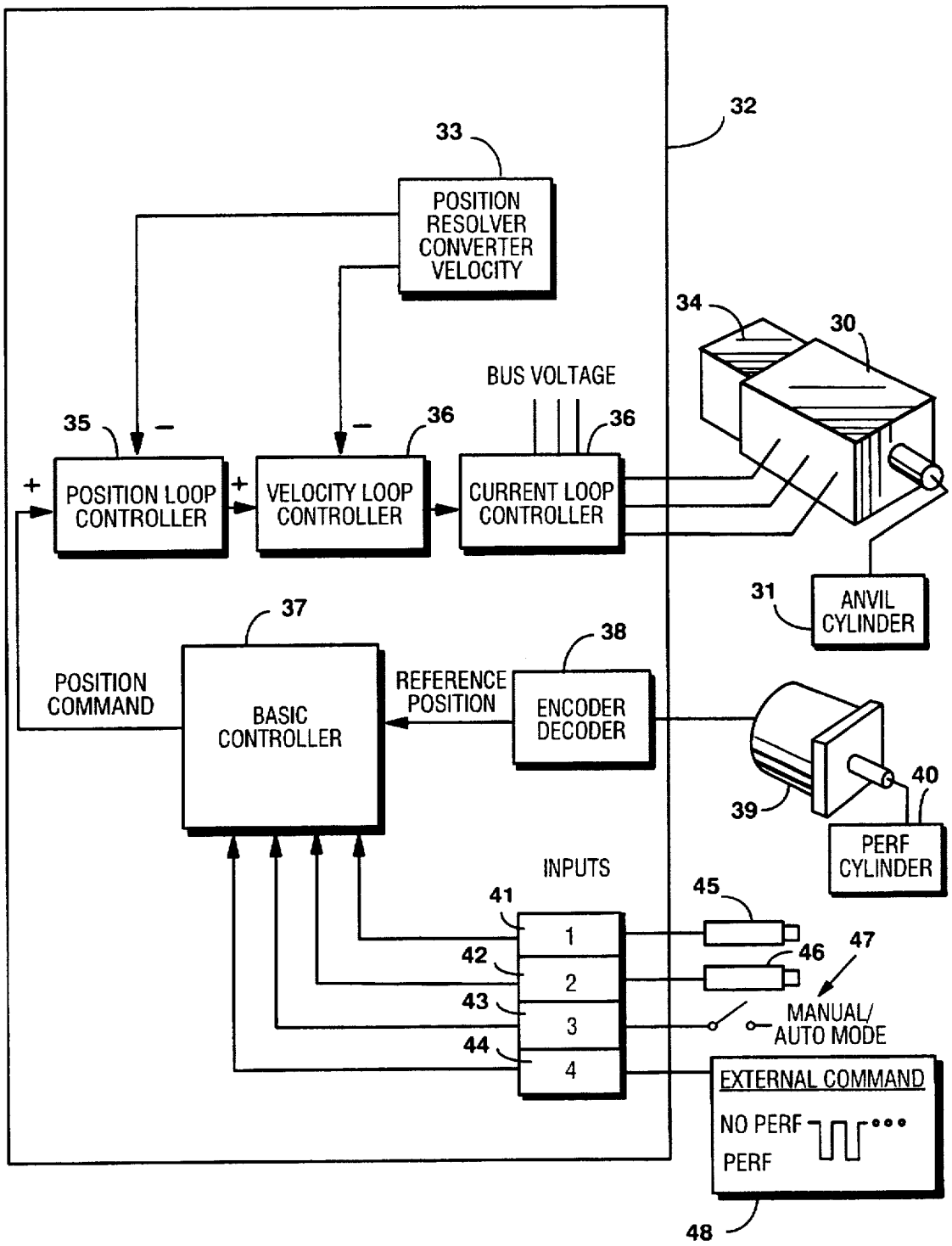
FIG. 3 is a control schematic illustrating control of apparatus components useful for the practice of the methods schematically illustrated in FIGS. 1 and 2.

While FIGS. 1 and 2 schematically illustrate schematically one form of an apparatus could take for practicing the method according to the present invention, a preferred more detailed embodiment is illustrated in FIGS. 3 through 6. FIG. 3 schematically illustrates a control for a conventional servo motor 30 that is connected to an anvil cylinder (illustrated schematically at 31 in FIG. 3), such as a PACSCI SC 750 or 754 servo motor, which is controlled by a controller 32.

The controller 32 comprises a computer controller, and includes as components thereof a resolver converter 33 connected to a resolver 34 of the servo motor 30. The resolver converter 33 is connected to the position loop controller 35 and a velocity loop controller 36, both connected through the current loop controller to bus voltage and servo motor 30. The basic controller 37 is also connected, through the position loop controller 35 to the servo motor 30, and receives input from an encoder/decoder 38 connected to an encoder 39 which in turn is operatively connected to the perf cylinder 40 (having one or more blades for cutting or perforating).

In addition to receiving inputs from the encoder/decoder 38, the basic controller 37 is connected to four other inputs 41–44. The input 41 is connected to a conventional perf blade sensor 45 while the input 42 is connected to an anvil tooth position sensor 46 while the input 43 is connected up to a switch 47 that is movable between manual and automatic modes, and/or for turning the entire apparatus on or off. Input 44 is connected to an external command 48, which provides the selective on demand perfing (or cutting) or no perfing (or no cutting).

Figure 4:
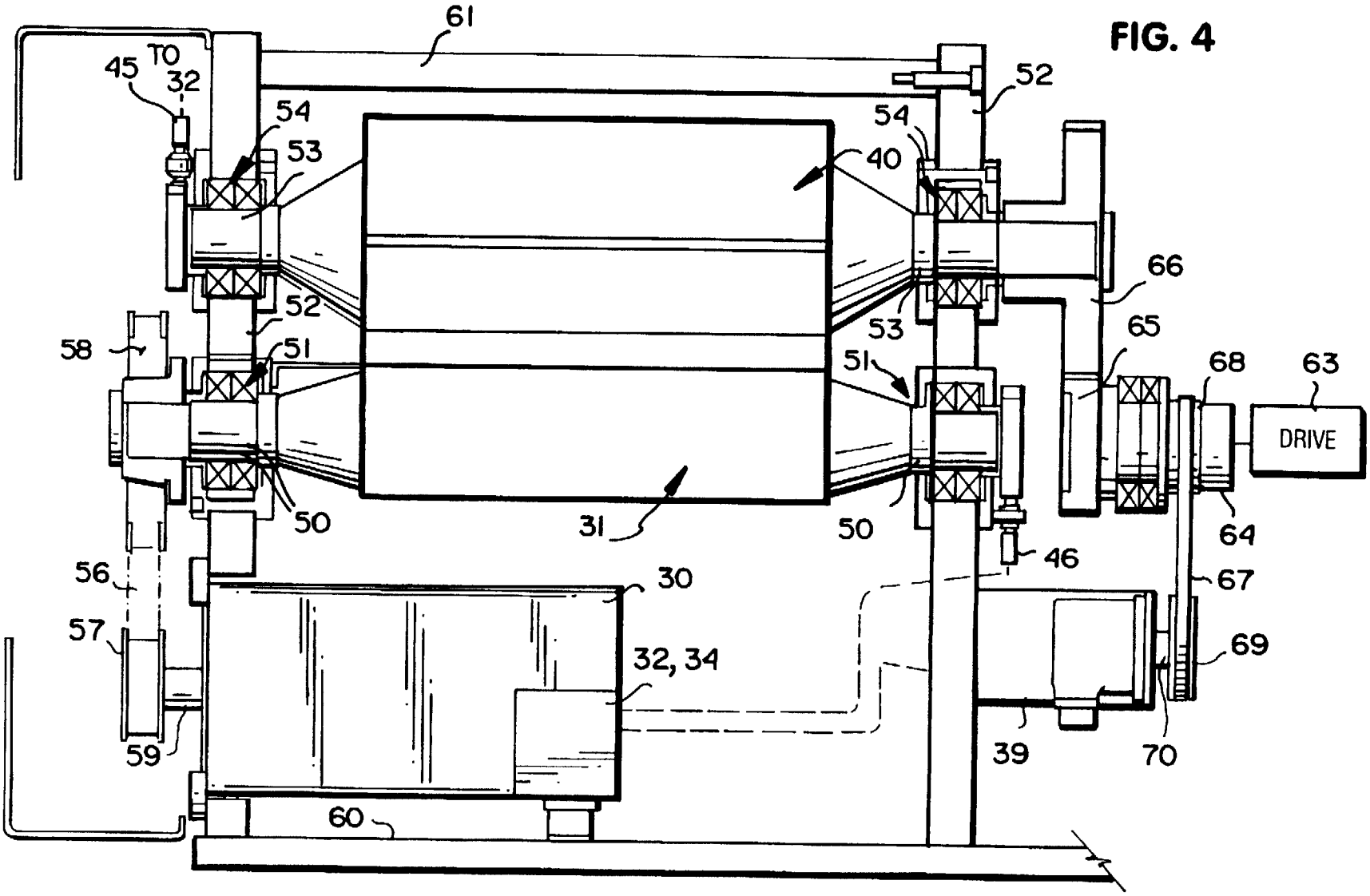
FIG. 4 is an end view of a detailed form of the apparatus of FIGS. 1 through 3.

FIG. 4 is an end view of a detailed form of apparatus according to the present invention illustrating the components from FIG. 3, and also other components, and more detailed. As seen in FIG. 4, the anvil cylinder 31 and the blade cylinder 40 are mounted for rotation about parallel (preferably substantially horizontal) axes. For example, the anvil cylinder 31 has end shaft stubs 50 received within bearings 51, of upright frame supports 52, while blade cylinder 40 has shaft stub portions 53 thereof received within bearings 54 also supported by the upright supports 52. The bearings 51, 54 are angular contact bearings and duplex pairs assembled back to back with stamped races facing one another.

The anvil cylinder 31 is driven by the servo motor 30, for example by a belt 56 extending between pulleys 57, 58, the pulley 57 connected to the shaft 59 for the servo motor 30 and the pulley 58 connected to the shaft stub 50. The anvil tooth position sensor 46 connected to the servo motor 30 is positioned/mounted below the cylinder 31 on support structure 60 of the frame, and a spacing/support bar 61 is provided above the cylinder 40 between the upright support structures 52. The sensor 46 is preferably mounted on the opposite side of the cylinder 31 from the pulley 58.

The drive for the knife cylinder 40 is illustrated schematically at 63 in FIG. 4, and may be an electric motor that is synchronously and continuously driven to maintain correct registration with the web (11 in FIGS. 1 and 2) at all times. Preferably drive 63 is a line shaft associated with a motor (shown schematically as the drive 14 in FIGS. 1 and 2) for powering the web 11.

The drive 63 is connected to the shaft 64 which in turn is connected to a gear 65 which drives the gear 66 connected to the shaft stub 53 at the right end of the cylinder 40 as seen in FIG. 4. On the opposite end of the cylinder 40 from the gear 66 is the proximity sensor 45, associated with the shaft stub 53 thereat.

FIG. 4 also shows the encoder 39 operatively connected to the shaft 64 and perf cylinder 40, the encoder 39 being driven by the shaft 64 in synchronism with the blade cylinder 40. For example, the encoder 39 may be driven by a belt 67 connected between the pulley 68 on the shaft 64, and the pulley 69 connected to the shaft 70 of the encoder 39.

Figure 5:
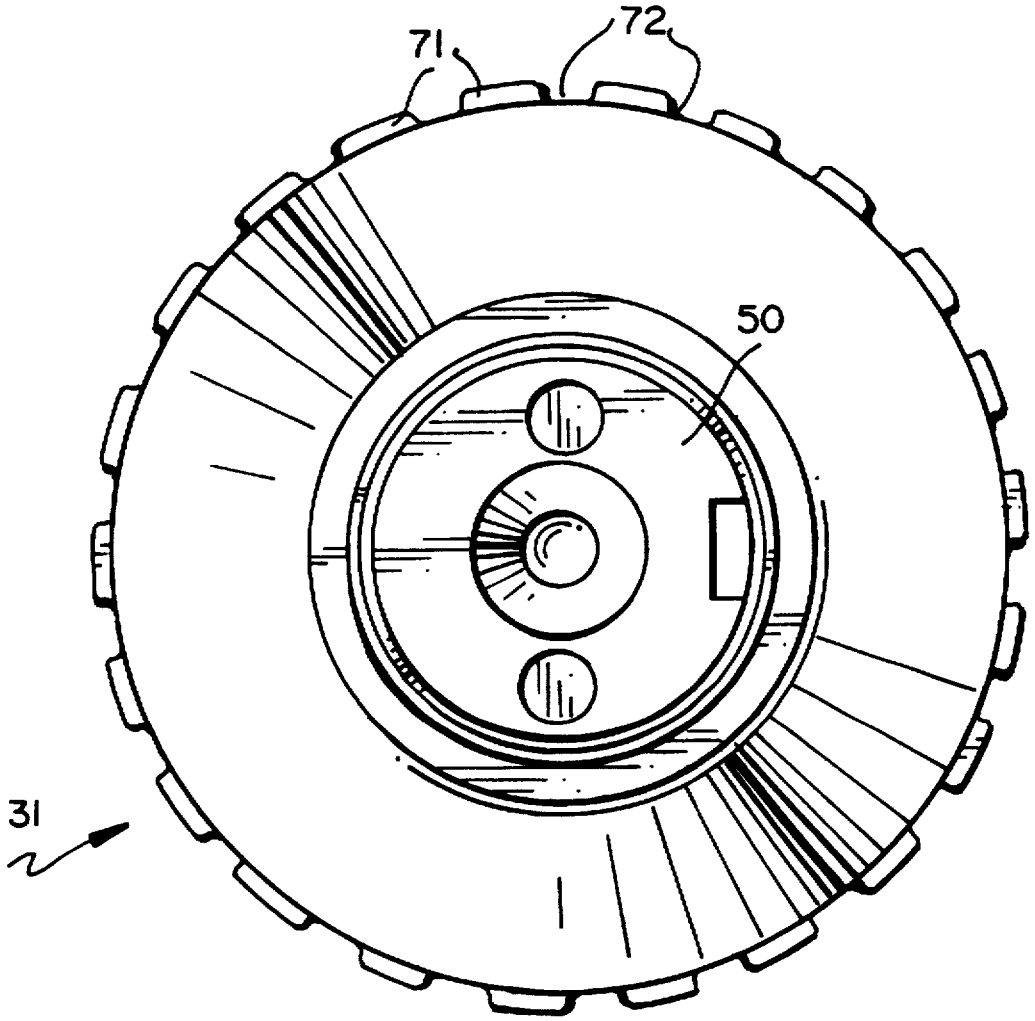
FIG. 5 is a side view of a preferred form of the anvil cylinder according to the present invention.

FIG. 5 is an end view of the preferred form of a perforation cylinder 31. Instead of having merely a single raised surface (as in the FIGS. 1 and 2 embodiment), the cylinder 31 has a plurality of raised surfaces 71 alternating with depressions 72. The cylinder 31 in effect is a wide face gear. For example, for an eleven inch circumference (as illustrated in FIG. 5) cylinder 31 about 20–25 (e.g. about 22) each of the alternating raised surfaces 71 and depressions 72 are provided. The surfaces and depressions 71, 72 are preferably substantially uniform, each raised surface 71 having an arcuate extent of between about 5–10 degrees, and the arcuate extents being substantially equal to each other. The raised surfaces 71 also have a substantially uniform height. The depressions 72 are substantially equal to each other and to the raised surfaces 71 (e.g. having a radial extent of between about 5–10 degrees). The anvil cylinder 31 is typically of metal. For example, the anvil cylinder 31 may be nitralloy 135 modified stock which is heat treated and uniformly ground.

Figure 6:
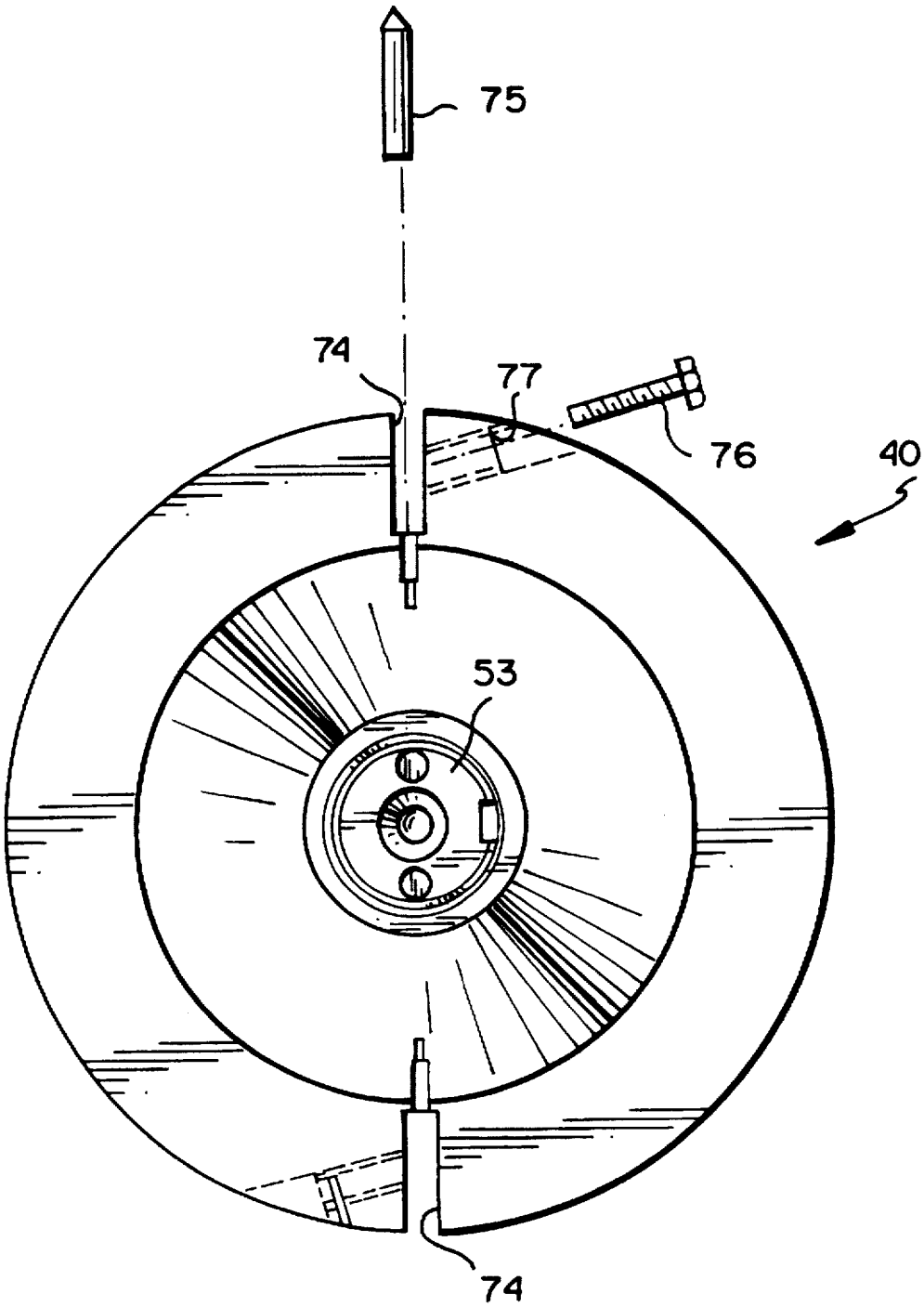
FIG. 6 is a front, exploded, view of the preferred form of knife cylinder according to the present invention.

FIG. 6 illustrates a preferred blade cylinder 40 having two in line slots 74 extending radially therein and intersecting the external periphery of the cylinder 40. Each of the slots 74 receives (or can receive) a blade 75. The blade 75 may be either a cutting (severing) or cross-perforating blade, and may be mounted by a seat in the slot 74 so that it is tightly received therein, and clamped in place, e.g. with a screw or bolt 76 extending through a threaded angled passageway 77 intersecting the slots 74. This makes it easy to replace the blade 75 when it is worn, or to change from cutting to perforating blades. The slots 74 are spaced approximately 180 degrees from each other.

During operation of the apparatus of FIGS. 3 through 6, the drive 63 drives the knife cylinder 40 in synchronism with a paper web or the like being acted upon. The position of the cylinder 40 is sensed by the proximity sensor 45. At the same time that the drive 63 is substantially continuously rotating the cylinder 40 as the web is moving, the servo motor 30 substantially continuously rotates the cylinder 31 in the opposite direction as the direction of rotation of the cylinder 40. The position of the anvil cylinder 31 is sensed by the proximity sensor 46. Drive of the knife cylinder 40 also effects rotation of the encoder 39. Data from the encoder 39 and from the sensors 45, 46 is provided to the basic controller 37. The basic controller 37 has a basic program that provides the gear ratio and control of when to decrement the anvil position such that the system perfs on demand from the external command 48.

The controller 32—while the knife cylinder 40 and the anvil cylinder 31 are being substantially continuously rotated—positively controls the position of the anvil cylinder 31 with respect to the knife cylinder 40 so that selectively a raised anvil surface 71, or depression 72, is brought into operative association with the knife blade 75 to selectively effect perforation or cutting of the web, or no perforation or cutting, respectively. Preferably this is accomplished by phase shifting the servo motor 30 about 5–10 degrees (depending upon the extent and positioning of the surfaces 71 and depression 72), such as by substantially constantly and instantly indexing the anvil cylinder 31 in a reverse direction (that is a direction opposite the direction of rotation of the cylinder 31). In this way the knife 75 acts with a different anvil surface 71 each cycle. This extends the life of the anvil cylinder 31 and reduces total system power, and since phase shifting takes place as the web is moving and the cylinders 31, 40 are rotating, high operating speeds are possible.

It will thus be seen that according to the present invention a highly advantageous method of acting on a moving web to effect selective cross perforation or cutting thereof, in a highly advantageous manner is provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and devices.

What is claimed is:

1. A method of acting on a moving web to effect perforation or cutting thereof, using a knife cylinder having at least one cutting or perforating knife blade and an anvil cylinder having at least one raised anvil surface for cooperating with the knife blade to effect cutting or perforation, and at least one depression adjacent the raised surface which does not effect perforation or cutting when cooperating with the knife blade, comprising the steps of:

(a) substantially continuously rotating the knife cylinder in substantial registration with the moving web;

(b) substantially continuously rotating the anvil cylinder; and (c) while practicing steps (a) and (b), positively controlling the position of the anvil cylinder with respect to the knife cylinder so that selectively said one raised anvil surface or said one depression is brought into operative association with the knife blade to selectively effect perforation or cutting of the web, or no perforation or cutting, respectively.

2. A method as recited in claim 1 wherein steps (b) and (c) are practiced by rotating the anvil cylinder with a servo motor, and phase shifting the anvil cylinder to change between perforating or cutting, or non-perforating or non-cutting, positions.

3. A method as recited in claim 2 wherein the anvil cylinder comprises a plurality of substantially uniform alternating raised surfaces and depressions; and wherein step (b) is practiced by rotating the anvil cylinder in a first direction; and wherein step (c) is practiced by substantially constantly and substantially instantly indexing the anvil cylinder in a direction opposite the first direction.

4. A method as recited in claim 3 wherein a computer controller is provided operatively connected to the knife and anvil cylinders, and comprising the further steps of sensing the locations of the knife and anvil cylinders and providing the sensed location information to the computer controller to facilitate practice of step (c).

5. A method as recited in claim 2 wherein step (c) is practiced by phase shifting the anvil cylinder between about five–ten degrees during each indexing action.

6. A method as recited in claim 1 wherein the anvil cylinder comprises a plurality of substantially uniform alternating raised surfaces and depressions; and wherein step (b) is practiced by rotating the anvil cylinder in a first direction; and wherein step (c) is practiced by substantially constantly and substantially instantly indexing the anvil cylinder in a direction opposite the first direction.

7. A method as recited in claim 1 wherein a computer controller is provided operatively connected to the knife and anvil cylinders, and comprising the further steps of sensing the locations of the knife and anvil cylinders and providing the sensed location information to the computer controller to facilitate practice of step (c).

8. A method as recited in claim 6 wherein step (c) is practiced by phase shifting the anvil cylinder between about five–ten degrees during each indexing action.

9. A method as recited in claim 1 wherein step (a)–(c) are practiced to effect perforation of the web.

10. A method as recited in claim I wherein steps (a)-(c) are practiced to effect cutting of the web.

11. Apparatus for cutting or perforating a web, comprising:

a knife cylinder having at least one cutting or perforating knife blade extending outwardly therefrom;

an anvil cylinder having a plurality of substantially uniformly alternatively raised anvil surfaces for cooperating with said knife blade to effect cutting or perforation, and depressions adjacent the raised surfaces which do not effect perforation or cutting when cooperating with a said knife blade;

a drive mechanism for driving said knife cylinder; and a servo motor operatively connected to said anvil cylinder to effect rotation thereof and for positively controlling the location of said anvil cylinder with respect to said knife cylinder during rotation of said anvil cylinder to selectively provide perforation or cutting, or no perforation or cutting.

12. Apparatus as recited in claim 11 wherein said anvil cylinder comprises between about 20–25 each of said alternating raised surfaces and depressions.

13. Apparatus as recited in claim 11 further comprising a computer controller for controlling operation of said servo motor; and a position sensor associated with each of said knife cylinder and said anvil cylinder for providing position information to said computer controller.

14. Apparatus as recited in claim 11 wherein said at least one blade comprises two blades spaced approximately 180 degrees from each other.

15. Apparatus for cutting or perforating a web, comprising:

a knife cylinder having at least one cutting or perforating knife blade extending outwardly therefrom;

an anvil cylinder having a plurality of substantially uniform anvil surfaces for cooperating with a said knife blade to effect cutting or perforation, and a plurality of substantially uniform depressions alternating with said raised surfaces which do not effect perforation or cutting when cooperating with a said knife blade;

a first drive mechanism for driving said knife cylinder; and a second drive mechanism for rotating said anvil cylinder in a first direction; and for substantially constantly and instantly indexing said anvil cylinder in a direction opposite the first direction to provide either perforating or cutting, or no perforating or cutting.

16. Apparatus as recited in claim 15 wherein said anvil cylinder comprises between about 20–25 each of said alternating raised surfaces and depressions.

17. Apparatus as recited in claim 15 further comprising an encoder operatively connected to said knife cylinder.

* * * * *